US007556174B2

(12) United States Patent
Gatski

(10) Patent No.: US 7,556,174 B2
(45) Date of Patent: Jul. 7, 2009

(54) CANDY STORAGE AND DISPENSING DEVICE AND METHOD OF USING THE SAME

(76) Inventor: Frank P. Gatski, 3400 W. Desert Inn Rd., Suite 24, Las Vegas, NV (US) 89102

( * ) Notice: Subject to any disclaimer, the term of this patent is extended or adjusted under 35 U.S.C. 154(b) by 343 days.

(21) Appl. No.: 10/927,250

(22) Filed: Aug. 26, 2004

(65) Prior Publication Data

US 2006/0071013 A1 Apr. 6, 2006

(51) Int. Cl.

| | |
|---|---|
| ***A24F 15/04*** | (2006.01) |
| ***G07F 11/00*** | (2006.01) |
| ***F42B 39/02*** | (2006.01) |
| ***A63H 33/04*** | (2006.01) |

(52) U.S. Cl. ..... 221/24; 221/185; 221/94; 221/96; 221/123; 221/126; 221/127; 221/133; 221/92; 446/75; 220/500; 220/501; 220/502; 220/507; 220/523; 220/524; 220/525

(58) Field of Classification Search ..... 221/94, 221/96, 123, 126, 127, 133, 92, 24, 11, 250, 221/185; 220/500, 501, 502, 507, 523, 524, 220/525; 446/75

See application file for complete search history.

(56) References Cited

U.S. PATENT DOCUMENTS

| | | | | |
|---|---|---|---|---|
| 2,035,340 | A * | 3/1936 | Primavera | 206/431 |
| 2,490,368 | A * | 12/1949 | Millstein | 446/76 |
| 2,529,661 | A * | 11/1950 | Millstein | 426/104 |
| 2,617,324 | A | 11/1952 | Brody | |
| 2,901,357 | A | 8/1959 | Epstein | |
| 3,138,249 | A | 6/1964 | Paulini | |
| 4,387,809 | A | 6/1983 | Botzler | |
| 4,798,313 | A | 1/1989 | Farley | |
| 4,896,792 | A * | 1/1990 | Marchand | 221/11 |
| 5,853,112 | A | 12/1998 | Coleman et al. | |
| 6,139,393 | A * | 10/2000 | Coleman et al. | 446/75 |
| 6,321,933 | B1 * | 11/2001 | Vandenberg | 221/24 |

* cited by examiner

*Primary Examiner*—Gene Crawford
*Assistant Examiner*—Rakesh Kumar
(74) *Attorney, Agent, or Firm*—Greenberg Traurig

(57) ABSTRACT

Disclosed is a candy storage and dispenser device. A multi-compartment dispensing device offers a unique device for storing and dispensing candy. Accordingly, multiple types and/or colors of candy may be contained in a transparent housing to create a very colorful presentation. Any number of candy types, including powdered, beads, pellets and the like, may be stored and dispensed with the multi-compartment device. The compartments are joined by a series of apertures which may, or may not, be regulated by a movable barricade. Then, when desired, the multiple candies are dispensed through the series of compartment apertures and a dispensing aperture. One version comprises a flute-shaped device having an operational mouthpiece.

10 Claims, 3 Drawing Sheets

CANDY STORAGE AND DISPENSING DEVICE AND METHOD OF USING THE SAME

FIELD OF THE INVENTION

The embodiments of the present invention relate to a device for storing and dispensing candy.

BACKGROUND

Yearly candy sales in the United States top $10 billion. Moreover, candy sales are expected to grow 3%-5% per year for the next five years. A rapidly growing trend in the candy industry is interactive candy or candy that is packaged with dispensers. Many dispensers are meant to be collectibles, while others are promotional, often used for movie or video game tie-ins.

Candy dispensers come in many different shapes and sizes. One of the first candy dispensers was known as the "Pixy-Stix." A Pixy-Stix is a closed paper tube, which resembles a straw, containing powdered and colored candy. In order to consume the candy, a user tears or bites off an end of the tube and pours the candy into their hands or mouth. U.S. Pat. No. 2,901,357 to Epstein illustrates one such paper tube. Unfortunately, when bitten or placed in one's mouth, ends of the paper tube become saturated with saliva causing the tube to seal unexpectedly. In response, a user must manually re-open the tube. The entire process tends to be messy and the mixture of powdered candy and saliva creates an undesirable paste-like substance.

Consequently, there have been numerous attempts to develop alternative dispensers for powdered candy and other small candy items. U.S. Pat. Nos. 3,138,249, 5,853,112 and 6,139,393 disclose such dispensers. However, each of the disclosed dispensers suffers from one or more drawbacks. That is, the dispensers are unsafe for children (e.g., have small detachable parts), complex and burdensome to manufacture and/or lack versatility.

Accordingly, there continues to be the need for an aesthetically pleasing candy dispenser remedying the drawbacks of previous dispensers while accomplishing the objective of dispensing candy in a manner entertaining to its users.

SUMMARY

Accordingly, a first embodiment of the present invention comprises a compartmentalized container for segregating different types and/or colors of candy. In one embodiment, the container takes the shape of a flute wherein multiple candy compartments are formed along its length. In the flute embodiment, each compartment may accommodate different candy (e.g., powder, small candy beads or pellets, etc.) and/or different colored candies. To enhance the flute-shaped dispenser, the flute includes an operational mouthpiece for creating an audible tone. A release mechanism provides a means for the user to dispense the candy through, for example, the mouthpiece of the flute.

Ideally, the container is fabricated of a transparent plastic so that the user may observe the various candies in the multiple compartments. In this manner, a rainbow of candy colors can be created to enhance the appearance of the dispenser.

While a flute has been described, other shapes, including a harmonica, whistle or animals, may be used to form the container. Other features, variations and embodiments will become evident from the detailed description, drawings and claims set forth below.

DETAILED DESCRIPTION

Figure 1:
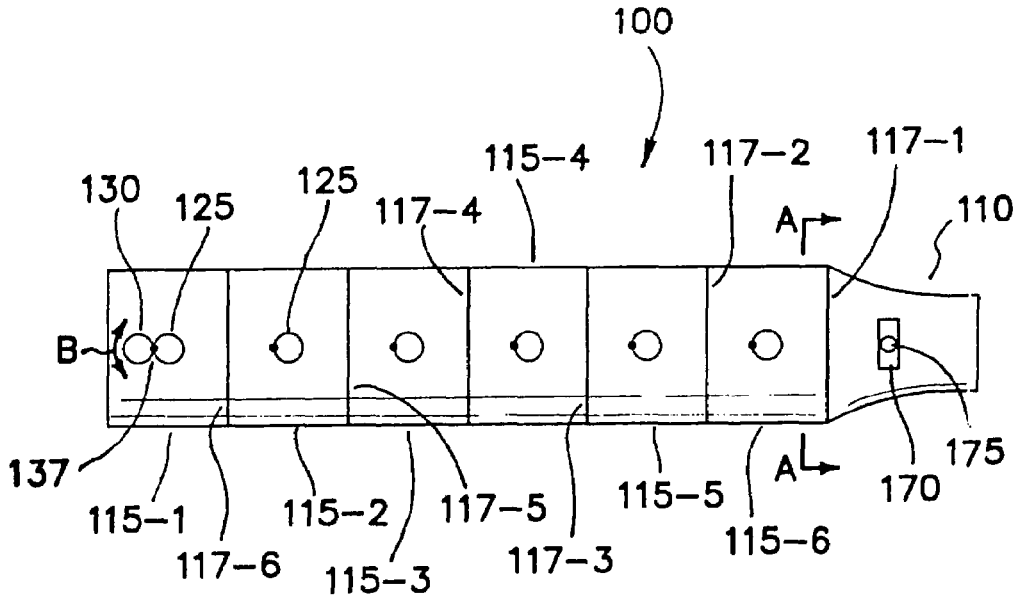
FIG. 1 shows a top view of a first flute embodiment of the present invention.
Figure 2:
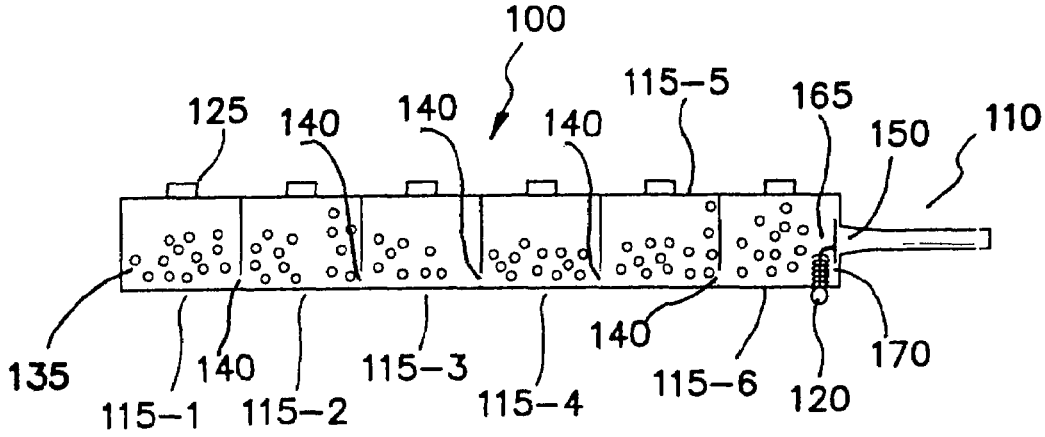
FIG. 2 shows a side view of the first flute embodiment of the present invention.

Reference is now made to the figures wherein like parts are referred to by like numerals throughout. FIGS. 1 and 2 show a first top and side view of a flute embodiment generally referred to by reference numeral 100. The flute 100 comprises a mouthpiece 110, multiple compartments 115-1 through 115-6, dividing walls 117 release unit 120, filler openings 125 and filler opening covers 130. The filler opening covers 130 are joined to the flute 100 by hinges 127 which allow the covers 130 to be opened by applying pressure in a sideways direction. In other words, the covers 130 rotate in a direction denoted by B in FIG. 1 about a top of the flute 130. The flute 100 may be made of any suitable material but ideally transparent plastic is used. The use of transparent material allows the candy 135 to be seen while contained in the flute 100. The candy 135 may be packaged in the flute 100 at the manufacturing facility and delivered to the retail outlets accordingly. As described in detail below, once the candy 135 is dispensed by a user, the flute 100 may include means for allowing the user to refill the flute 100 as desired.

Figure 3:
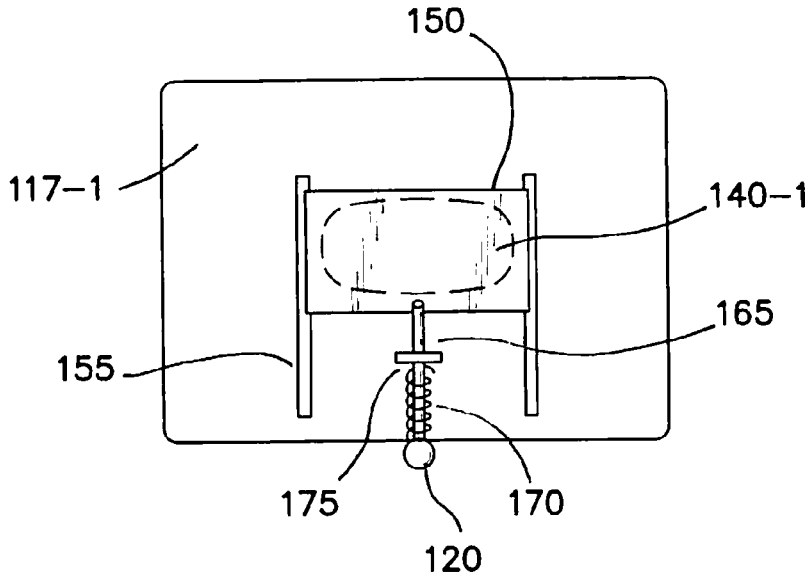
FIG. 3 shows a cross-sectional width view along direction A of the first flute embodiment of the present invention.

The release unit 120 provides means for dispensing the contained candy 135. While the release unit 120 shown is a knob, it can also be a lever, button, handle, finger, rib or similar feature. In a first embodiment, as shown in FIG. 3, each compartment 115-1 through 115-6 includes an aperture 140 in a wall 117 thereof. The size of the apertures 140 dictates the size of the candy 135 that may be readily contained and dispensed by the flute 100. To dispense the candy 135 the release unit 120 is pulled away or lifted from the flute container 100 thereby opening an internal movable cover 150 of the aperture 140-1 in the mouthpiece 110. The cover 150 moves along parallel tracks 155 in the wall 117-1. Then, the user tilts the flute container 100 and pours the candy 135 through the compartment apertures 140, including the opened mouthpiece aperture 140-1, and into their hand or mouth. The release mechanism 120 is attached to the cover 150 of the mouthpiece aperture 140-1 by an elongated substantially rigid member 165. A spring 170 and disc 175 interact to force the cover 150 to its closed position once the user releases the knob 120. A locking mechanism (not shown) may also hold the knob 120 in an open position until the user is ready to close the aperture 140-1.

Figure 4:
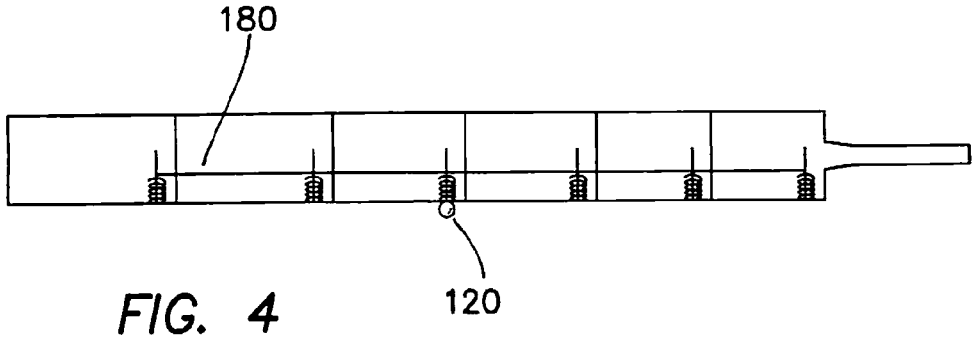
FIG. 4 shows a transparent side view of a second flute embodiment of the present invention.
Figure 5:
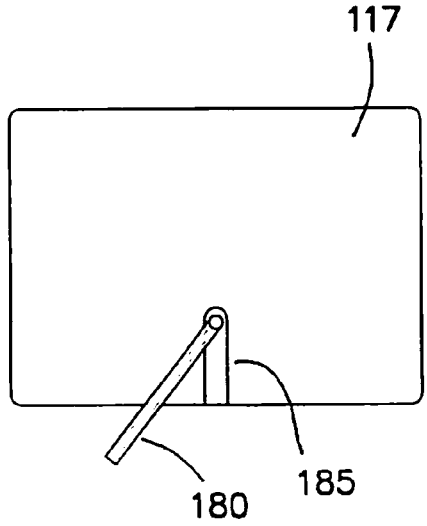
FIG. 5 shows a view of a wall of the second embodiment of the present invention.

In a second embodiment shown in FIG. 4, each compartment aperture 140 incorporates a movable cover 150. In the second embodiment, each of the compartment covers 150, including the mouthpiece cover 150-1, is controlled by the release mechanism 120. Thus, once the release mechanism 120 is pulled away from the flute 100, each of the compartment covers 120 is moved to an open position allowing the candy 135 to flow freely from the compartments 115-1 through 115-6 and into the user's mouth or hands. A rod 180 connected to the substantially rigid member 165 joins each cover 150-1 through 150-6. As shown in FIG. 5, a slot 185 in each compartment wall 117-1 through 117-6 allows the rod 180 to move vertically such that the covers 150-1 through 150-6 may open. Upon release of the knob 120, the spring 170 and disc 175 force the covers 150-1 through 150-6 to their closed position.

Figure 6:
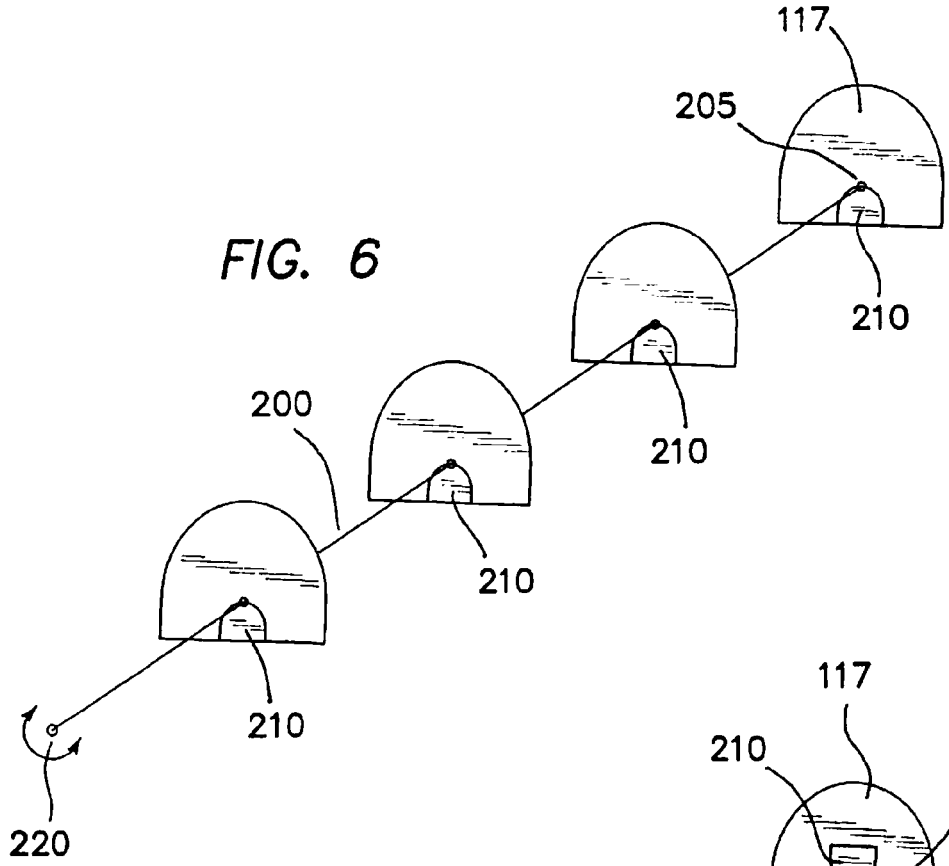
FIG. 6 shows a perspective view of a third embodiment of the present invention.
Figure 7:
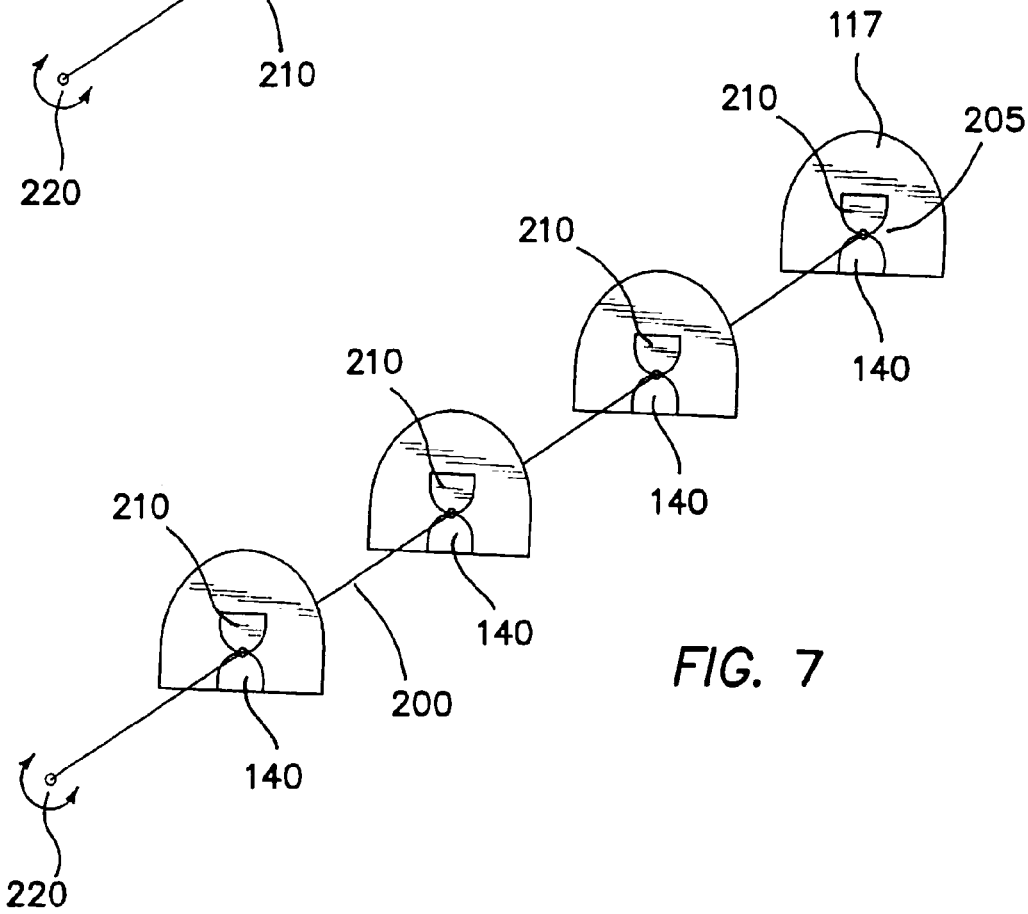
FIG. 7 shows a perspective view of covers open in the third embodiment of the present invention.

In a third embodiment, shown in FIGS. 6 and 7 a shaft 200 extends the length of the flute 100 and rotatably attaches at a first end to a compartment wall 117. Ideally, the first end of the shaft 200 resides within a cylindrical or circular channel 205 having one open end. The shaft 200 supports one or more covers 210. In an embodiment similar to that shown in FIGS. 4 and 5, the shaft 200 supports a cover 210 for each compartment aperture 140. Upon turning the shaft 200 (as indicated by the arrow) via knob 220 affixed to a second end of the shaft 200, the covers 210 move to allow the candy to flow through the compartment apertures 140. Friction between the first end of the shaft 200 and circular channel wall restrains the shaft 200 and covers 210 in a fixed position until acted on by the user. Alternatively, the channel 205 and first end of the shaft 200 may each be threaded to facilitate a secure engagement therebetween.

The size of the compartment apertures 140 and mouthpiece aperture 140-1 dictate the size of the candy 135 which can be suitably contained and dispensed by the flute 100. Accordingly, the flute 100 may accommodate powdered candy, small candy items and/or coated candy. Different candies may be mixed and matched as desired. For example, a rainbow effect may be created by placing different colored candies in each transparent compartment 115-1 through 115-6. Refilling the flute 100 may be accomplished by pouring candy 135 through each individual external opening of the compartments 115-1 through 115-6. Similarly, a user may retrieve candy from each compartment 115-1 through 115-6 individually by opening the filler opening cover 130 and pouring the candy 135 from the desired compartment 115-1 through 115-6.

While it is not mandatory, the flute 100 may be made operational by utilizing the mouthpiece 110. To create an audible tone the mouthpiece 100 incorporates an opening 170 and restrains a ball 175. Therefore, as air is blown through the mouthpiece 110 the ball 175 blocks a portion of the opening 170 causing the creation of an audible tone. Also, in an alternative embodiment, buttons along the flute container 100 may be functional to allow the flute 100 to discharge multiple tones and notes.

Even though the description has focused on a flute embodiment, any number of other container shapes are conceivable. For example, a container having a harmonica or whistle shape may incorporate multiple compartments for containing different types and/or colors of candies. Indeed, the shape does not need to be of an instrument or related sound-generating device. That is, the device may take any form, including that of animals (e.g., snake, alligator or shark). In fact, the shape may be dictated by a movie promotion or similar external influence.

Although the invention has been described in detail with reference to several embodiments, additional variations and modifications exist within the scope and spirit of the invention as described and defined in the following claims.

I claim:

1. A candy container and dispenser comprising:

a housing;

a plurality of compartments spaced consecutively from a rear to a front of said housing, each said compartment having at least one passageway in at least one wall thereof, said passageways aligned consecutively along a length of the housing from the rear to the front of said housing such that candies contained in each compartment spaced rear of a front most compartment must pass through multiple compartments forward thereof to be dispensed;

moveable passageway barriers in each of said passageways;

control means operable to control said passageway barriers such that said barriers may be opened and closed simultaneously;

at least one dispensing aperture, said dispensing aperture regulated by a movable member and integrated into said front most compartment; and manipulation means disposed on said housing for manipulating the movable member for opening and closing the dispensing aperture.

2. The container of claim 1 wherein the housing is transparent.

3. The container of claim 1 wherein the housing is flute shaped.

4. The container of claim 3 wherein the dispensing aperture is incorporated in a mouthpiece of said housing.

5. The container of claim 3 wherein said manipulation means is a button on said housing.

6. A flute-shaped candy dispensing device comprising:

an elongated housing;

a series of compartments spaced consecutively from a rear to a front of said housing, one or more walls of each compartment having a similarly placed passageway wherein said passageways are aligned consecutively along a length of the elongated housing from the rear to the front of said housing such that candies contained in each compartment spaced rear of a front most compartment must pass through multiple compartments to be dispensed through said front most compartment;

moveable passageway covers in each of said passageways;

a control device operable to control said passageway barriers such that said covers may be opened and closed simultaneously;

a mouthpiece at one end of the housing, said mouthpiece having an aperture in communication with said front most compartment of the series of compartments; and means in communication with said housing for opening and closing said mouthpiece aperture.

7. The device of claim 6 wherein the mouthpiece is operational such that an audible tone is created when air is forced through the mouthpiece.

8. The device of claim 6 wherein the means for opening and closing the mouthpiece aperture is a button on said housing.

9. The device of claim 6 wherein the housing is transparent.

10. A candy container and dispenser comprising:

a housing;

a plurality of compartments spaced consecutively from a rear to a front of said housing, each said compartment having a passageway in one or more walls thereof, said passageways aligned consecutively along a length of the housing from the rear to the front of said housing such that candies contained in each compartment spaced rear of a front most compartment must pass through multiple compartments to be dispensed;

covers for opening and closing each passageway;

a control device, said control device operable to commonly control each of the covers such that said covers may be opened and closed simultaneously;

at least one dispensing aperture, said dispensing aperture regulated by a movable member and integrated into said front most compartment; and manipulation means disposed on said housing for manipulating the movable member for opening and closing the dispensing aperture.

* * * * *